United States Patent [19]

Bergstein

[11] 4,051,992

[45] Oct. 4, 1977

[54] CYLINDRICAL DISPLAY CONTAINER FORMED FROM A FLAT BLANK

[75] Inventor: Robert M. Bergstein, Cincinnati, Ohio

[73] Assignee: Bergstein PackagingTrust, Middletown, Ohio

[21] Appl. No.: 681,819

[22] Filed: Apr. 30, 1976

[51] Int. Cl.[2] ..... B65D 3/04

[52] U.S. Cl. ..... 229/21; 206/45.34; 229/4.5

[58] Field of Search ..... 229/4.5, 5.5, 21, 23, 229/93; 206/45.34, 45.31, 45.33

[56] References Cited

U.S. PATENT DOCUMENTS

| | | | |
|---|---|---|---|
| 2,040,041 | 5/1936 | Clark, Jr. | 229/8 X |
| 2,115,309 | 4/1938 | Koch | 206/45.34 X |
| 2,172,864 | 9/1939 | Calva et al. | 229/4.5 X |
| 2,176,955 | 10/1939 | Clow | 229/4.5 X |
| 2,275,542 | 3/1942 | Menges | 229/4.5 UX |
| 2,464,278 | 3/1949 | Wilson | 229/93 X |
| 2,661,891 | 12/1953 | Arranga et al. | 206/45.34 X |
| 2,974,825 | 3/1961 | Ross | 229/5.5 X |
| 3,273,702 | 9/1966 | Palmer | 206/45.31 |
| 3,339,715 | 9/1967 | Bruno | 229/45.31 |
| 3,342,320 | 9/1967 | Stelzer et al. | 206/45.34 |
| 3,747,830 | 7/1973 | Goldman | 229/21 |

*Primary Examiner*—Davis T. Moorhead

*Attorney, Agent, or Firm*—Melville, Strasser, Foster & Hoffman

[57] ABSTRACT

A tubular display container having a body and end caps, the body being formed from a knocked-down flat-folded blank having a paperboard panel and a flexible plastic panel, the paperboard panel having attachment flaps hingedly connected to its opposite side edges to which the opposite side edges of the plastic panel are secured, the blank upon being erected to tubular configuration having correspondingly configured end caps snugly received in its opposite ends, the end caps preferably being provided with one or more annular ridges adapted to coact with one or more ridge defining score lines in the paperboard panel to releasably lock the end caps in place.

1 Claim, 8 Drawing Figures

CYLINDRICAL DISPLAY CONTAINER FORMED FROM A FLAT BLANK

BACKGROUND OF THE INVENTION

The present invention relates basically to cylindrical containers, and more particularly to a display container a portion of which is formed from a transparent material so that the contents of the container may be readily inspected by a prospective purchaser.

Numerous forms of cylindrical containers have hitherto been proposed, including the use of various types of end caps to close the opposite ends of the cylindrical bodies. Normally, the container bodies are formed from rigid or essentially rigid tubes, such as spiral wound laminated tubing wherein a plurality of plies of paperboard stock are wound about a mandrel and adhered together as an incident of the winding operation. A spiral wound container does not afford visibility of the contents and has to be decorated by adding a separate printed label or covering wrapped around its body. In the case of molded or extruded transparent plastic tubing, while offering visible display of the contents, the tubing, if it is to be printed or decorated, requires individual printing using rubber plate printing techniques which do not provide sharp or distinctive images. In all cases, however, the cylindrical bodies are sufficiently rigid so that they cannot be collapsed for shipment or storage purposes.

In contrast to the foregoing, the present invention provides tubular display containers the bodies of which are formed as knocked-down flat-folded structures which form cylindrical or oval bodies when erected. In addition to the advantage of shipping the containers in flat condition, the invention provides distinct display and graphic advantages.

SUMMARY OF THE INVENTION

In accordance with the invention, the tubular body is composed of two parts, the first comprising a paperboard blank scored to form a body panel and a pair of relatively narrow attachment flaps extending along its opposite side edges, together with a sheet of flexible but self-sustaining plastic material which is of a size to overlie the paperboard panel with its marginal side edges secured to the attachment flaps. The invention takes full advantage of the paperboard blank, which both folds and flexes, and the flexibility of the plastic sheet, which flexes but does not fold. Thus the paperboard blank provides a body panel which can be flexed or bowed to the desired shape of the container being formed, with the attachment flaps providing a means to hingedly connect the plastic panel to the paperboard panel, the plastic panel also flexing to the desired shape of the container being formed. To this end, the width of the paperboard body panel is equal to one-half the perimeter of the tubular container body, with the width of the plastic panel also equal to substantially one-half the perimeter of the container body, although the width of the plastic panel may be somewhat smaller, depending upon the widths of the attachment flaps; but in any event, the width of the plastic panel must be great enough to extend between and overlap the free side edges of the attachment flaps when the latter are infolded to overlie the paperboard body panel.

Since the containers are formed from initially flat sheets of paperboard and plastic, they can be readily preprinted by lithography or other printing techniques which will provide high quality reproduction. Thus, the invention provides a composite container in which the parts can be efficiently and effectively printed in multiple colors by any desired process, and at the same time a visual display of the contents is provided through the plastic portion of the body.

The container body may be fabricated using automated folding and gluing equipment. In an exemplary apparatus, the paperboard panel may be advanced in a path of travel in the direction of the score lines hingedly connecting the attachment flaps to the body panel, with suitable sweep means positioned to engage and infold the attachment flaps relative to the body wall panel. Prior to the infolding of the attachment flaps, stripes of adhesive will be applied to the uppermost or inner surfaces of the attachment flaps and as the blanks advance, the plastic sheets will be deposited on the underlying paperboard body wall panels so that, upon infolding of the attachment flaps, they will be adhesively secured to the marginal side edges of the plastic sheets, thereby forming each blank into a knocked-down flat-folded tubular body.

When the body is erected, which may be readily accomplished by pressing inwardly on the score lines which define the opposite side edges of the flat-folded blank, the body will assume a tubular condition, which may be cylindrical or eliptical, the final shape of the container body being determined by the end caps which close its opposite ends, the end caps preferably comprising plastic caps having configured body portions of a size to be snugly received within the ends of the container body.

While the snug fit of the end caps may be utilized to maintain the parts in assembled relation, it is preferred to releasably lock the end caps in place; and to this end it has been found that an extremely effective yet releasable lock can be provided by scoring the marginal end edges of the paperboard body panel to provide inwardly projecting ridges, and providing one or more outwardly projecting annular ridges on the body portions of the end caps which enter into mating engagement with the ridge defining score lines. Even though the ridge defining score lines extend throughout only one-half the circumference of the container body, an extremely tight locking engagement is obtained; yet upon the application of force, the end caps may be repeatedly removed and replaced, the end caps maintaining their tight engagement with the container body when reinserted.

If greater visibility of the enclosed merchandise is desired, the paperboard body panel may be provided with a window-forming opening which may be covered by a sheet or film of plastic material adhered to the inner surface of the paperboard panel about the periphery of the window opening. Such sheet or film may be of lighter weight than the plastic sheet forming the opposite side of the container body since it is supported by the paperboard panel and need not be self-sustaining. Such arrangement achieves the effect of an all plastic body with visibility both front and back.

DESCRIPTION OF THE PREFERRED EMBODIEMNTS

Figure 1:
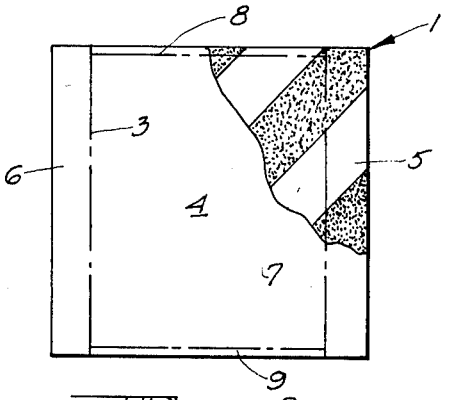
FIG. 1 is a plan view of a paperboard blank which defines a body panel and articulated attachment flaps.

Referring first to FIG. 1, a paperboard blank, indicated generally at 1, is provided with longitudinal score lines 2 and 3 which divide the blank into a central body panel 4 and a pair of attachment flaps 5 and 6 hingedly connected to the opposite side edges of the body panel along the aforementioned score lines. If decorative effects are desired on the inner surface of the blank, a sheet of decorated paper or foil, indicated at 7, may be laminated to the inner surface of the blank, or the blank may be suitably printed if its inner surface is of quality to receive printing ink.

In accordance with a preferred embodiment of the invention, the body panel 4 is provided with inwardly projecting ridge defining score lines 8 and 9 extending across the full width of the blank adjacent its end edges, such score lines coacting with the end plugs to securely yet releasably lock them in the erected container body.

Figure 2:
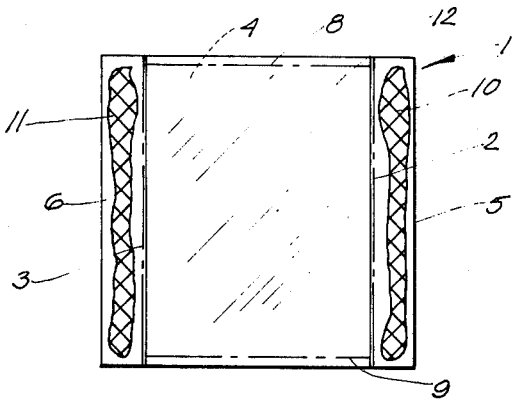
FIG. 2 is a plan view similar to FIG. 1 in which a plastic body forming panel is juxtaposed on the paperboard panel.

In the fabrication of the blank into a knocked-down container structure, the blank is preferably advanced in a path of travel indicated by the Arrow A in FIG. 2, and as the blank is advanced, stripes of adhesive 10 and 11 are applied to the uppermost or inner surfaces of the attachment flaps 5 and 6, respectively, and a rectangular sheet of transparent plastic material 12 is deposited on the central body panel 4. The sheet of transparent plastic material 12 will be of substantially the same size as the body panel 4 and provides an opposing body panel defining the opposite half of the cylindrical container body being formed. The material from which the plastic panel is formed does not constitute a limitation on the invention, although it should be self-sustaining and yet sufficiently flexible to permit it to be bowed into semi-cylindrical configuration. Plastic sheets of vinyl or acetate having a thickness of about 7 mils have been found to be particularly suited for the purpose, and it has also been found preferable to cut the plastic with its grain orientation extending lengthwise of the container body to achieve smooth and uniform flexing of the sheet. As used herein, the term "self-sustaining" is intended to denote a condition in which the plastic panel is flexible yet sufficiently rigid to maintain its shape, as opposed to a thin film of sheet material which is limp and lacking in sufficient body to maintain its shape.

Figure 3:
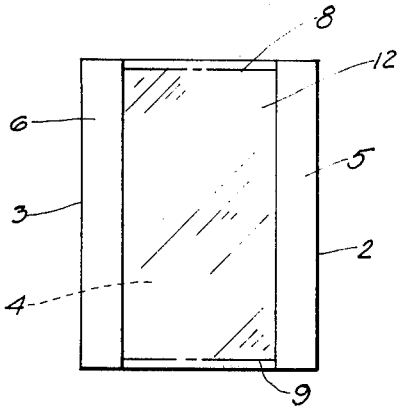
FIG. 3 is a plan view illustrating the knocked-down flat-folded container blank.
Figure 4:
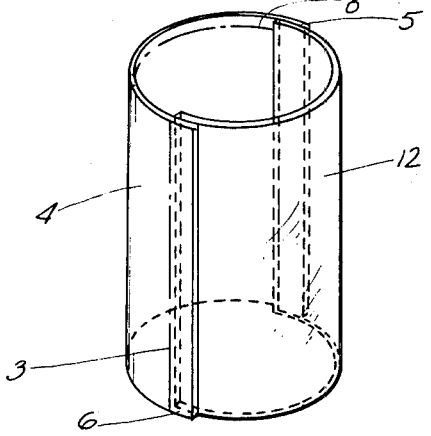
FIG. 4 is a perspective view illustrating the container blank in the erected condition.

The knocked-down structure is completed by infolding the attachment flaps 5 and 6 and adhesively securing them to the opposite side edges of the plastic body panel, the parts thereby assuming the condition illustrated in FIG. 3. The container bodies may be stored and shipped to the user in the flat-folded condition, thereby effecting substantial savings in space requirements, as opposed to shipping the container bodies in tubular form. In the hands of the user, the container blanks may be readily erected by pressing inwardly along the opposite side edges of the flat blanks, i.e., along the score lines 2 and 3, thereby bowing the opposing body panels 4 and 12 outwardly, the structure assuming the erected condition illustrated in FIG. 4, which in this instance is cylindrical.

Figure 5:
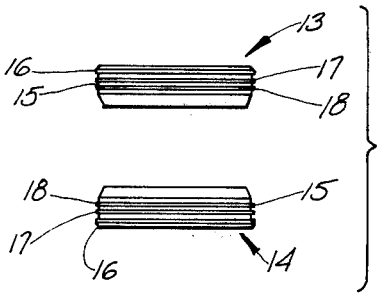
FIG. 5 is a side elevational view of a pair of end caps for closing the opposite ends of the container body.
Figure 6:
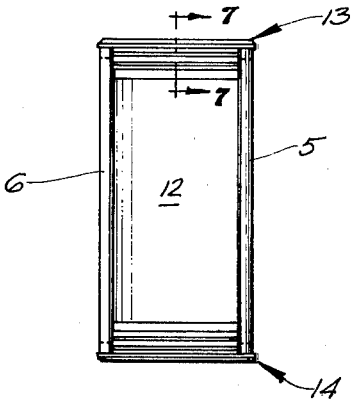
FIG. 6 is a front elevational view of the assembled container with the end caps in their closed positions.
Figure 7:
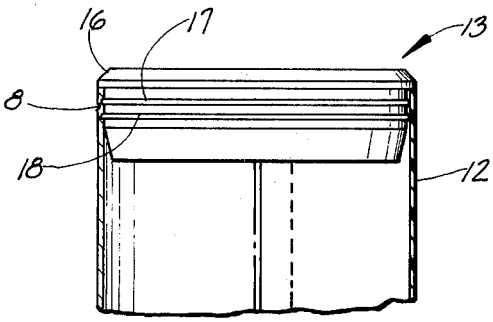
FIG. 7 is an enlarged fragmentary vertical sectional view taken along the line 7—7 of FIG. 6 illustrating the manner in which the groove defining score lines in the paperboard body panel coact with the annular grooves on the end caps to lock the end caps in place.

The container is completed by inserting a pair of end caps, indicated generally at 13 and 14 in FIG. 5, into the opposite ends of the erected container body, the completely assembled container being illustrated in FIG. 6. In this embodiment, each of the end caps has a cylindrical body portion 15 of a size to be snugly received within the ends of the container body, together with an annular flange 16 at its outermost end adapted to seat against the end edges of the container body. While end caps which are snugly received within the container body will provide reasonably tight engagement between the parts, it has been found that the strength of the engagement can be greatly enhanced by providing the cylindrical body portions 15 of the end caps with one or more annular ridges, such as the spaced apart pairs of annular ridges 17 and 18, which coact with the ridge defining score lines 8 and 9 in paperboard body panel 4. Thus, as seen in FIG. 7, the inwardly projecting ridge defining score line 8 seats between the annular ridges 17 and 18 when the end cap is seated in its fully closed position, thereby providing a positive lock maintaining the end cap in tight engagement with the container body. While the positive locks so formed extends only throughout the width of body panel 4, it has been found that such locking engagement is extremely effective. While a preferred embodiment has been illustrated, it will be understood that other arrangements of the mating sets of ridges may be utilized. For example, spaced apart pairs of ridge defining score lines may be provided in body panel 4, and a single annular flange provided on the cylindrical body of the end cap. Alternatively, the ridge defining score lines in body panel 4 can be received in mating annular grooves in the cylindrical bodies of the end caps, or conversely the score lines can be formed from the opposite side of the paperboard blanks to define grooves to receive the annular flanges on the end caps.

Figure 8:
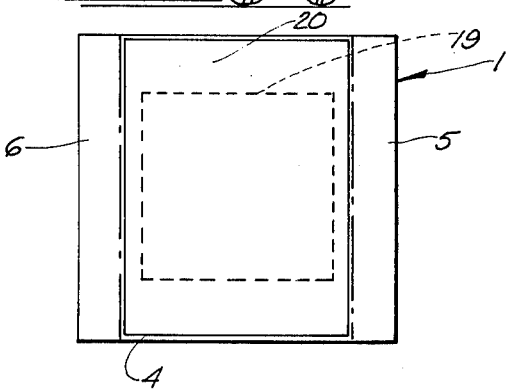
FIG. 8 is a plan view of a modified paperboard blank incorporating a window opening.

FIG. 8 illustrates a modification of the invention wherein like parts have been identified by like reference numerals. In this embodiment the body panel 4 is provided with a window defining opening 19 covered on the inner surface of body panel 4 by a sheet of transparent material 20 adhesively secured to the body panel. The transparent sheet 20 may comprise the same plastic material used for body panel 12, although a more flexible and even limp sheet of film may be employed since it is supported by the body panel. It will be understood that the window defining opening 19 may be of any desired shape depending upon the degree of visibility desired and the decorative effects to be achieved.

As should now be evident, the instant invention provides a relatively inexpensive and easy to manufacture tubular container initially formed in knocked-down flat-folded condition which also facilitates storage and shipment of the containers prior to their erection and subsequent use. In addition to providing for the display of the packaged merchandise, numerous decorative effects can be achieved to enhance the eye appeal of the container. The end caps, which are preferably formed of plastic, may be either transparent or opaque, and they too may be suitably colored or otherwise decorated.

Modifications may be made in the invention without departing from its spirit and purpose. A number of modifications have already been set forth and others will undoubtedly occur to the worker in the art upon reading this specification. For example, while the invention is particularly suited for the production of cylindrical container bodies from flat-folded structures, the container bodies need not be of cylindrical configuration, but may be oval or eliptical in cross-section, with the end plugs configured to produce the desired tubular configuration. Accordingly, it is not intended that the invention be limited other than in the manner set forth in the claims which follow.

The embodiments of the invention in which an exclusive property or privilege is claimed are defined as follows:

1. A display container consisting of a cylindrical body and a pair of end caps, said cylindrical body being formed from a knock-down, flat-folded blank having a paperboard body panel and a pair of attachment flaps hingedly connected to its opposite side edges, and a transparent body panel in opposing relation to said first named body panel with its opposite side edges secured to said attachment flaps, said transparent body panel being formed from a self-sustaining flexible sheet of plastic material, said first named paperboard body panel having a width equal to one-half the perimeter of the container body when erected into essentially cylindrical form, with the remaining one-half of the container body defined by said transparent body panel and said attachment flaps, said attachment flaps acting to hingedly connect the opposite side edges of said transparent panel to said paperboard body panel, whereby the flat-folded blank may be erected to cylindrical configuration by flexing the body panels outwardly relative to each other, whereupon the end caps may be inserted into the opposite ends of the cylindrical body to maintain it in erected condition and close its opposite ends, said end caps having annular body portions of a size to be snuggly received in the ends of the container body when in essentially cylindrical form, at least one annular ridge on the body portion of each of said end caps, and ridge defining score lines in said paperboard body panel extending parallel to and adjacent the opposite end edges thereof, said score lines being positioned to enter into operative engagement with the annular ridges on the body portions of said end caps, whereby to tightly secure the end caps to said container.

* * * * *